United States Patent [19]

Niehaus et al.

[11] 4,390,367

[45] Jun. 28, 1983

[54] HIGH-ALLOYED STEEL BEING RESISTIVE TO CORROSION BY NATURAL GAS

[75] Inventors: Norbert Niehaus, Düsseldorf; Rolf Pöpperling, Mülheim; Horst Bester, Krefeld, all of Fed. Rep. of Germany

[73] Assignee: Mannesmann Aktiengesellschaft, Düsseldorf, Fed. Rep. of Germany

[21] Appl. No.: 275,337

[22] Filed: Jun. 19, 1981

[30] Foreign Application Priority Data

Jun. 25, 1980 [DE] Fed. Rep. of Germany ..... 3024380

[51] Int. Cl.[3] ..... C22C 38/22; C22C 38/38

[52] U.S. Cl. ..... 75/125; 75/128 A; 75/128 N; 75/128 W; 148/37; 148/38; C22C/38/20

[58] Field of Search ..... 75/125, 128 W, 128 A, 75/128 N; 148/37, 38

[56] References Cited

U.S. PATENT DOCUMENTS

| | | | |
|---|---|---|---|
| 3,726,668 | 4/1973 | Bäumel | 75/125 |
| 3,785,787 | 1/1974 | Yokota et al. | 75/125 |
| 3,910,788 | 10/1975 | Fujioka et al. | 75/125 |
| 4,055,448 | 10/1977 | Fujikura et al. | 75/125 |
| 4,099,966 | 7/1978 | Chivinsky et al. | 75/125 |

*Primary Examiner*—W. Stallard

*Attorney, Agent, or Firm*—Ralf Siegemund

[57] ABSTRACT

Steel is to be austenitic-ferritic at a 1:1 ratio of austenite to ferrite and contains particular alloy elements. The principal feature is, limiting the sulphure content to below 0.005% in order to obtain a particularly high toughness transversely to the main direction of working.

4 Claims, 3 Drawing Figures

HIGH-ALLOYED STEEL BEING RESISTIVE TO CORROSION BY NATURAL GAS

BACKGROUND OF THE INVENTION

The present invention relates to a high-alloyed, passivatible, austenitic-ferritic steel alloy and to a method of making and using pipes or receptacles from blanks or billets made of such an alloy.

High-alloyed steel is used for pipes, tubes, and equipment that conduct, hold, process, and otherwise transport and handle acidic gases, such as natural gas. An alloy of this type is described, for example, in German printed patent application No. 26,16,599. This alloy has the following consistency (all percentages by weight):

0.001 to 0.12% carbon
0.2 to 1.5% silicon
0.5 to 8.0% manganese
12.0 to 30.0% chromium
2.0 to 16.0% nickel
0.1 to 5.0% molybdenum
0.01 to 1.2% titanium
0.01 to 1.6% niobium
0.01 to 3.5% copper
0.01 to 0.35% nitrogen The remainder being iron and the usual metalloids.

This known steel is, indeed, satisfactory with respect to resistence to corrosion from hydrogen sulfide and carbon dioxide as well as chlorides, provided these components contained in natural gas do not exceed rather critical limits. This known alloy is also strong and can be welded. However, ductability and toughness, particularly at low temperatures (e.g., −70° C.) is not satisfactory.

DESCRIPTION OF THE INVENTION

It is an object of the present invention to provide a new and improved steel alloy which meets the requirements for corrosion resistance, is quite strong, and can be welded. Moreover, the steel should still be very tough at low temperatures such as −70° C.

It is a particular object of the present invention to improve pipes or other containers concerning low temperature ductility.

It is another object of the present invention to provide a new and improved, weldable high alloy, passivatible, austenticferritic steel alloy of high strength and elastic limit.

It is a feature of the present invention to provide such a steel at an austenite-to-ferrite ratio of approximately 1:1; the alloy to be improved further is to have (all percentages by weight)

up to 0.05% carbon
20% to 25% nickel
5.0 to 9.5% nickel
3.0 to 6.0% molybdenum
0.01 to 2.5% copper
0.1 to 1.5% silicon
0.5 to 2.5% manganese
0.05 to 0.3% nitrogen The remainder being iron and the usual metalloids.

In accordance with the preferred embodiment of the invention, it is suggested to restrict the sulphur content (weight) to 0.005% maximum because it has been found that a sulphur content below that limit is critical for obtaining a high degree of toughness transversely to the main direction of plastic deformation of the steel. Preferably, this steel alloy is annealed by a solution treatment and, subsequently, cold-worked at a degree of plastic deformation of at least 3%.

Table 1 below identifies by numbers 1 through 5 the five different alloys having the stated consistency as far as additives to the iron are concerned:

TABLE 1

| No. | % C | % Si | % Mn | % P | % S | % N | % Cr | % Ni | % Mo | % Cu |
|---|---|---|---|---|---|---|---|---|---|---|
| 1 | 0.030 | 0.63 | 1.76 | 0.009 | 0.002 | 0.13 | 21.96 | 6.75 | 3.46 | <1.5 |
| 2 | 0.026 | 0.65 | 1.75 | 0.010 | 0.005 | 0.14 | 22.30 | 6.96 | 3.53 | <1.5 |
| 3 | 0.029 | 0.57 | 1.77 | 0.010 | 0.010 | 0.14 | 22.02 | 6.58 | 3.45 | <1.5 |
| 4 | 0.026 | 0.63 | 1.73 | 0.009 | 0.014 | 0.14 | 22.40 | 6.80 | 3.51 | <1.5 |
| 5 | 0.030 | 0.62 | 1.77 | 0.010 | 0.016 | 0.13 | 21.96 | 6.71 | 3.47 | <1.5 |

Table 2 below identifies the same examples (Nos. 1 to 5), listing for each of them yield point, tensile strength, and impact notch work, longitudinally as well as transversely to the principal direction of the cold-working deformation:

TABLE 2

| No. | Yield Point $R_p$ 0.2 (N/mm²) | Tensile Strength $R_m$ (N/mm²) | Notch Impact Work (ISO − $V_1$ + 20° C.) Longitudinally | Transverse |
|---|---|---|---|---|
| 1 | 524 | 738 | 298 | 208 |
| 2 | 530 | 757 | 298 | 156 |
| 3 | 528 | 744 | 260 | 125 |
| 4 | 535 | 743 | 222 | 81 |
| 5 | 528 | 754 | 206 | 50 |

Yield point and tensile strength values are stated in Newtons per millimeter squares and the notch impact work in joule. The alloys No. 1 and 2 are composed in accordance with the present invention. The alloys No. 3, 4, and 5, all have components in the same ranges and quite close to those of the alloys No. 1 and 2, except that their sulphur content is higher. To be sure, the sulphur content is still relatively low, a fraction of one-tenth of one percent; but the states limit of 0.005% in examples 3, 4, and 5 is definitely exceeded (twofold to threefold). Table 2 reveals that the yield point and tensile strength are quite similar for all examples; but toughness, prepresented by notch impact work, particularly in the transverse direction, is drastically increased by the reduction of sulphur content.

DESCRIPTION OF THE DRAWINGS

The drawings illustrate further certain features of the inventive alloy: in particular:

Proceeding now to the details of the drawings, FIG. 1 shows transverse and lengthwise notch impact work for austenitic steel of 1.4401 (squares) at a temperature of 20° C. The terms "lengthwise" and "transverse" refer to the direction of cold-working undergone by the steel. Additionally, FIG. 1 shows two curves for the same kind of notch impact work, however now for austenitic-ferritic steel (circles), in which the nonsulphur components are as per Table 1. The steel has in each instance been thermally treated; i.e. annealed, for obtaining a solid solution. One can observe a drastic increase in toughness for a sulphur content below 0.005% and for notching in the directions transversely to the direction of cold-working. FIG. 2 illustrates that the notch impact work in this transverse direction, though decreasing with temperature, is still very high for a sulphur content of approximately 0.002%. The relatively high value for a temperature of −70° C. is particularly noteworthy.

FIG. 3 illustrates notch impact work for samples 1 (circles) and 5 (squares) in Table 1, and for each instance notch in longitudinal and transverse directions is depicted. The sulphur content is thus used as a parameter; the abscissa shows relative deformation of cold-working ($\epsilon$). One can still see that cold-hardening will even in severe cases not very drastically reduce the notch impact work, the steel remains quite tough. A sulphur content of 0.016% produces clearly a drastic reduction in toughness.

Figure 1:
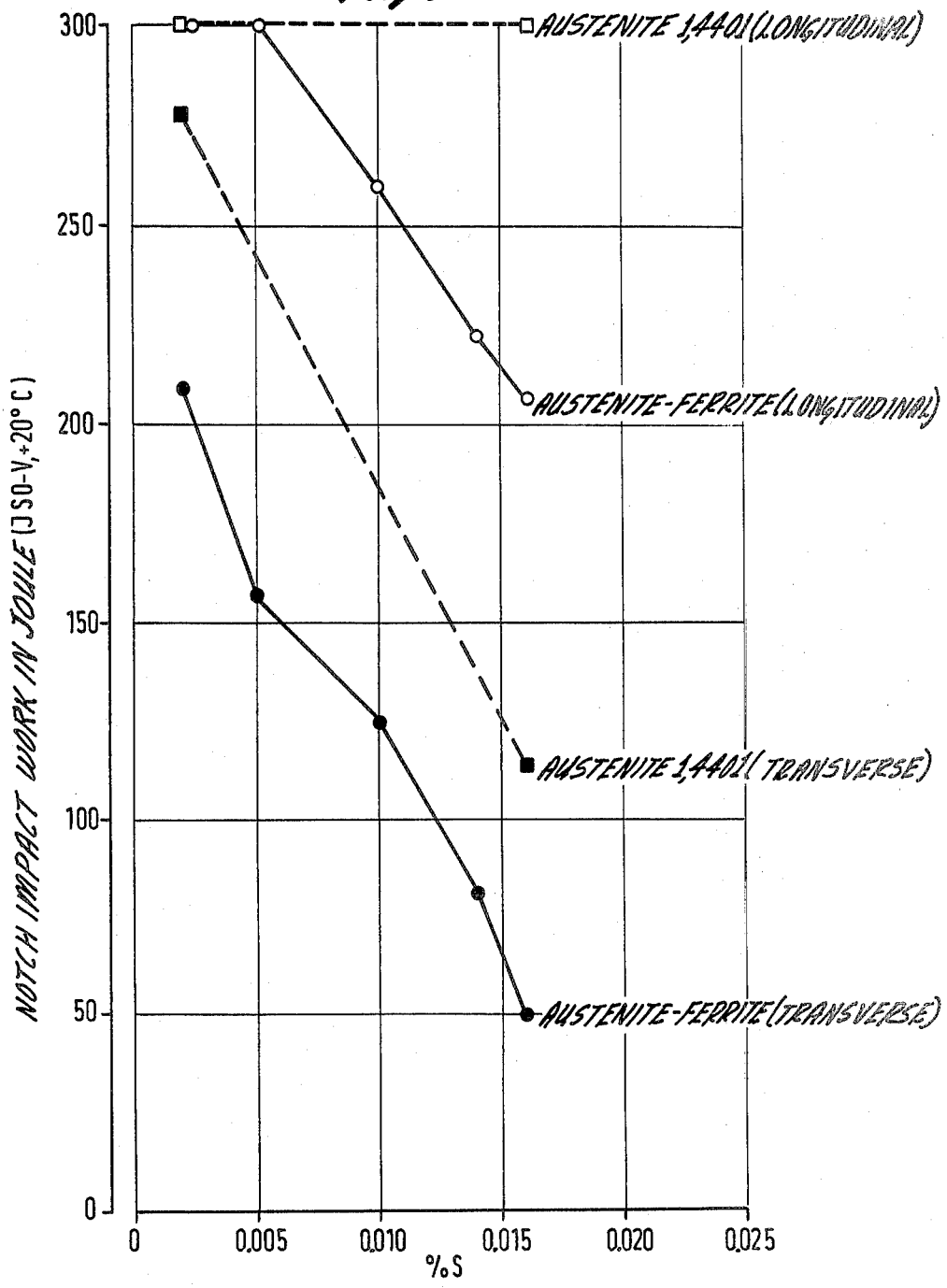
FIG. 1 is a diagram showing impact notch work in joule in dependence upon the sulphur content at room temperature.
Figure 2:
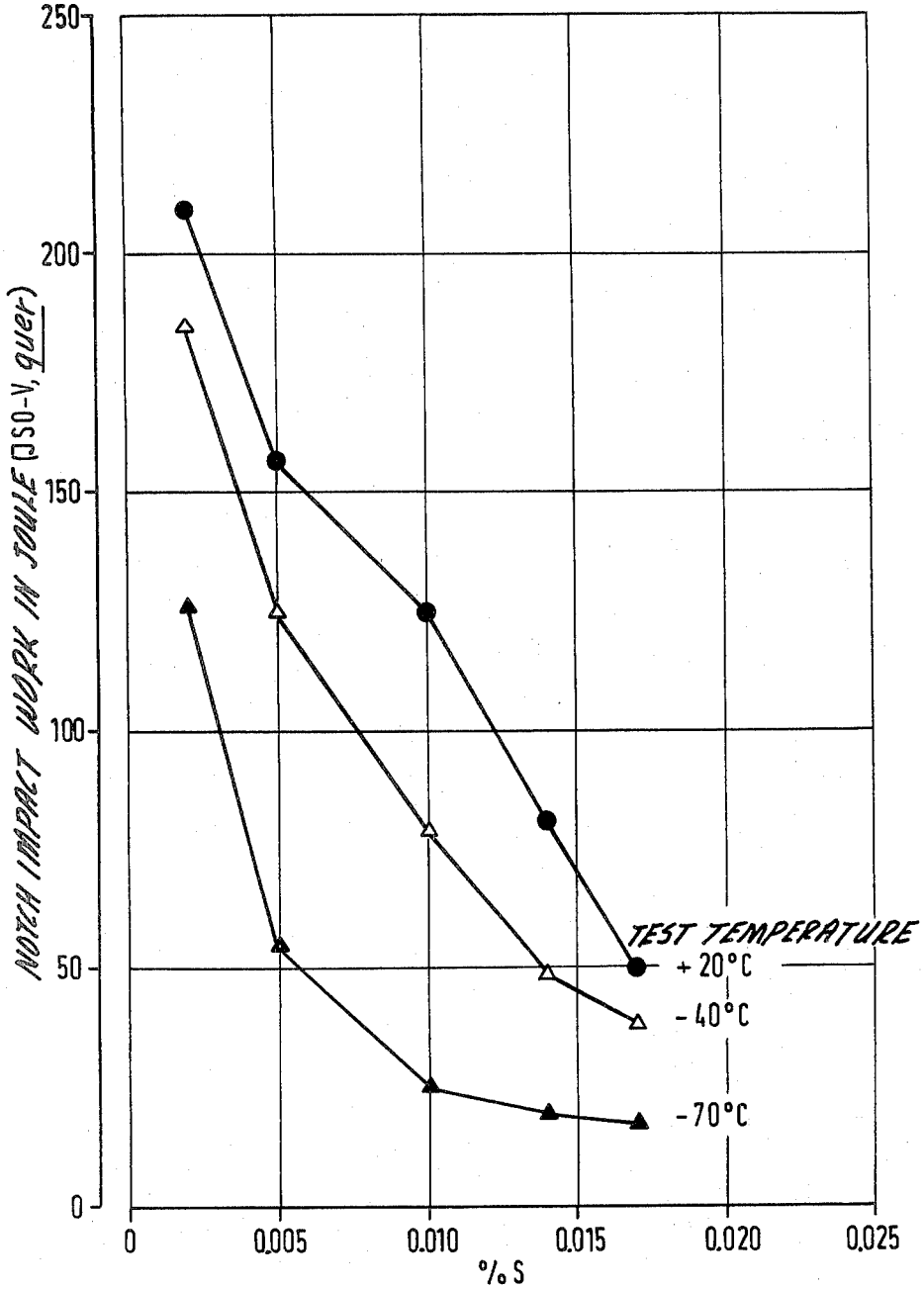
FIG. 2 is a similar diagram, showing impact notch work for one of the sample alloys, but at different temperatures.
Figure 3:
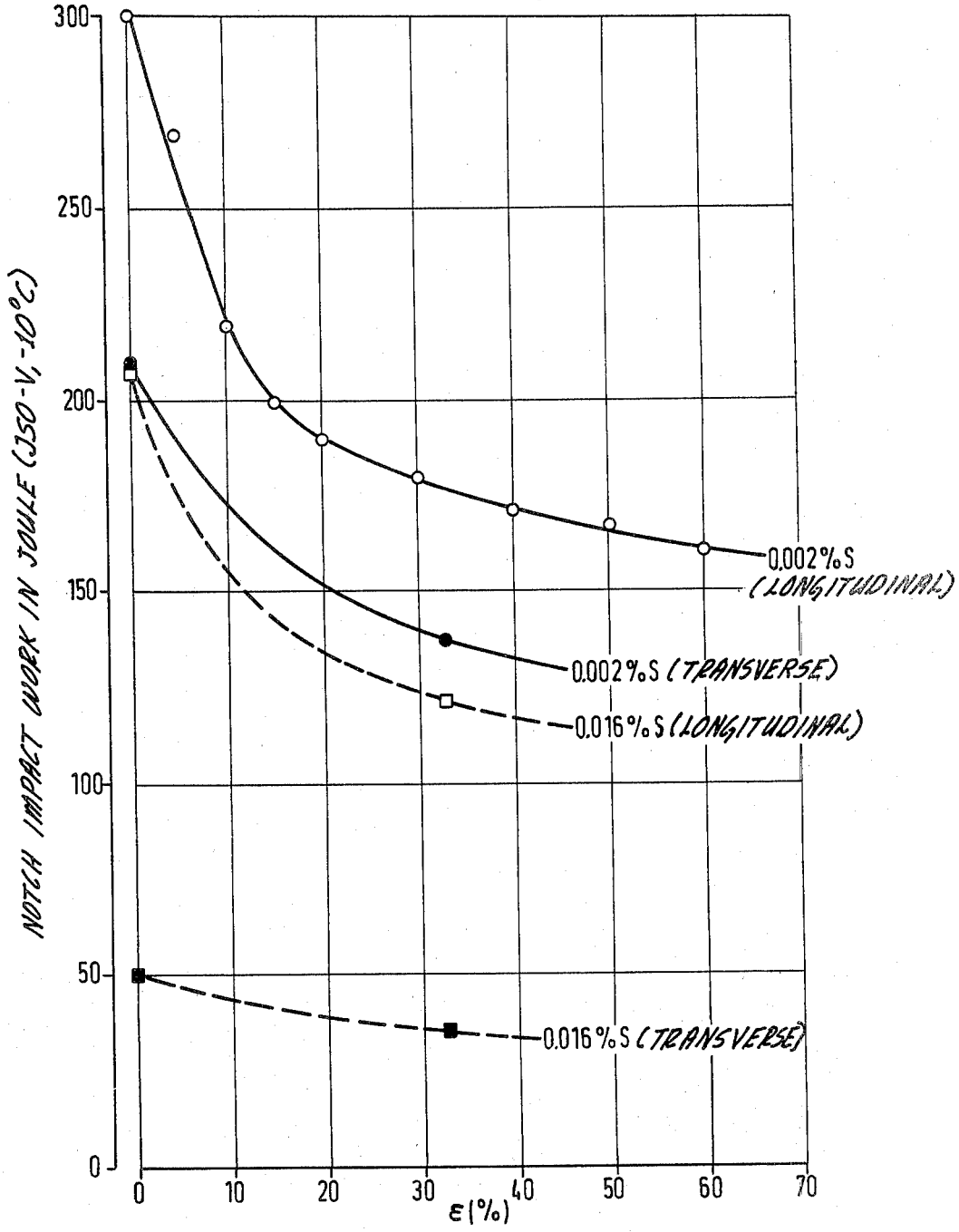
FIG. 3 is a diagram in which relative deformation ($\epsilon$) is plotted against notch impact work for different sample alloys, their sulphur content being a parameter.

A steel of this type is very suitable as raw material for the making of tubing, receptacles, and containers to be operated at a low temperature and for the conduction, storage, and/or processing of acidic natural gas. This steel is particularly resistant to chlorides, hydrogen sulfide, and carbon dioxide contained in such a gas or other media. The steel blanks to be used for making such pipes, containers, etc., are preferably solution treatment annealed, followed by cold-working, for a degree of plastic deformation in excess of 3%. The final product is particular resistance against stress corrosion cracking as well as against wearing corrosion. The material is tough, particularly at low temperatures.

The invention is not limited to the embodiments described above; but all changes and modifications thereof, not constituting departures from the spirit and scope of the invention, are intended to be included.

We claim:

1. Highly alloyed, weldable, passivatible, austenitic-ferritic steel alloy, having a tensile strength and elastic limit, comprising:

Up to 0.05% carbon
20.0 to 25.0% chromium
5.0 to 9.5% nickel
3.0 to 6.0% molybdenum
0.01 to 2.5% copper
0.1 to 1.5% silicon
0.5 to 2.5% manganese
0.05 to 0.3% nitrogen the remainder being iron for a 50%-to-50% ratio of austenite to ferrite; and a sulphur content not exceeding 0.005% in order to obtain a high toughness transversely to a direction of principle plastic deformation.

2. In a method of making a steel product such as tubes and containers, using blanks consisting of a steel alloys as set forth in claim 1, comprising, in addition, cold-working the blank.

3. A device for the conduction of acidic-corrosive gases comprising a pipe made of steel in accordance with claim 1.

4. A device for the storage of acidic-corrosive gases comprising a container made of steel in accordance with claim 1.

* * * * *